US010556328B2

(12) United States Patent
Palmer

(10) Patent No.: US 10,556,328 B2
(45) Date of Patent: Feb. 11, 2020

(54) INLINE SCREWDRIVER WITH HANDS-FREE ACTIVATED DUAL-DRIVE SELF-RATCHETING MECHANISM

(71) Applicant: Leon Robert Palmer, Somerset, MA (US)

(72) Inventor: Leon Robert Palmer, Somerset, MA (US)

( * ) Notice: Subject to any disclaimer, the term of this patent is extended or adjusted under 35 U.S.C. 154(b) by 0 days.

(21) Appl. No.: 15/731,895

(22) Filed: Aug. 21, 2017

(65) Prior Publication Data

US 2019/0047124 A1 Feb. 14, 2019

Related U.S. Application Data

(60) Provisional application No. 62/495,382, filed on Sep. 13, 2016.

(51) Int. Cl.

| | |
|---|---|
| ***B25B 15/04*** | (2006.01) |
| ***B25B 23/16*** | (2006.01) |
| ***B25B 17/00*** | (2006.01) |

(52) U.S. Cl.

CPC ..... *B25B 15/04* (2013.01); *B25B 17/00* (2013.01); *B25B 23/16* (2013.01)

(58) Field of Classification Search

CPC ..... B25B 15/04; B25B 17/00; B25B 17/02; B25B 23/16

See application file for complete search history.

(56) References Cited

U.S. PATENT DOCUMENTS

| | | | | |
|---|---|---|---|---|
| 5,881,609 | A * | 3/1999 | Palmer | B25B 13/462 192/43 |
| 9,126,314 | B1 * | 9/2015 | Chu | B25B 17/00 |
| 9,572,616 | B2 * | 2/2017 | Vaughn | A61B 17/8875 |
| 9,757,845 | B2 * | 9/2017 | Nassab | B25B 13/48 |
| 9,770,813 | B2 * | 9/2017 | Wang | B25B 23/18 |
| 9,796,070 | B2 * | 10/2017 | Sun | B25G 1/085 |
| 9,895,793 | B2 * | 2/2018 | Shiao | B25B 15/04 |
| 10,046,443 | B2 * | 8/2018 | Sun | B25B 15/04 |
| 2017/0100821 | A1 * | 4/2017 | Sun | B25B 23/0035 |
| 2017/0165815 | A1 * | 6/2017 | Wang | B25B 15/02 |
| 2017/0239791 | A1 * | 8/2017 | Daly | B25B 15/02 |
| 2017/0259410 | A1 * | 9/2017 | Chang | B25B 15/02 |

* cited by examiner

*Primary Examiner* — David B. Thomas
(74) *Attorney, Agent, or Firm* — Michael D. Eisenberg

(57) ABSTRACT

The mechanical technology of converting oscillatory motion, into one direction of rotation, as described and claimed in U.S. Pat. No. 5,881,609, while being efficient, useful and having numerous applications, has its disadvantage of not being able to function unless user employs both hands; one hand to apply oscillatory motion to an input, while opposite hand immobilizes the axial rotation of the converting gear-train, in order for the conversion to be activated. Hence, the goal of this documentation, is to teach several different means, that maintain the immobility of axial rotation of the dual-drive gear train in order to activate the dual-drive feature, without the use of either of user's hands, thereby conveniently leaving one of user's hands available for holding a work piece.

15 Claims, 15 Drawing Sheets

INLINE SCREWDRIVER WITH HANDS-FREE ACTIVATED DUAL-DRIVE SELF-RATCHETING MECHANISM

CROSS-REFERENCE TO RELATED APPLICATIONS

The present application claims priority from U.S. Provisional Application Ser. No. 62/495,382 filed on Sep. 13, 2016, which is hereby incorporated herein by reference in its entirety.

BACKGROUND OF INVENTION

The mechanical technology of converting oscillatory motion, into one continuous direction of rotation, as described and claimed in U.S. Pat. No. 5,881,609, while being efficient, useful and having numerous applications, has its disadvantage of not being able to function unless user employs both hands; one to apply oscillatory motion to an input, while opposite hand immobilizes the axial rotation of the converting gear-train, in order for the conversion to be activated. Hence, the goal of this documentation, is to teach several different means, that maintain the immobility of axial rotation of the dual-drive gear train in order to activate the dual-drive feature, without the use of either of user's hands, thereby conveniently leaving one hand available for holding a workpiece.

While the aforementioned mechanical technology has numerous known applications for numerous markets, applicant selected a screwdriver, solely as an ideal exemplification of an application.

The dual-drive gear-train mechanism, shown in all illustrations, operates in the same manner in both directions of output rotation, whereas, the means, to prevent axial rotation of the dual-drive gear-train without the use of either of user's hands, are alternative means in each illustration.

BRIEF SUMMARY OF EMBODIMENTS OF THE INVENTION

In a variant, a dual-drive mechanism system, configured to be set to a clockwise rotational output mode and to convert oscillatory axial motion applied to its input, into solely clockwise rotation motion at its output further configured to be set to a counterclockwise rotational output mode and to convert oscillatory axial motion applied to its input, into solely counter-clockwise rotation motion at its output, comprising an in-line input-handle configuration, featuring a means configured to immobilize the axial rotation of collar without the use of either of user's hands, while user applies clockwise and counter-clockwise axial rotation to the input handle at the posterior end, thereby enabling user to activate the 2×-drive feature and an invertible gear-train; wherein one output is configured to multiply rotational speed, while the opposite output reduces speed, single-handedly.

A work piece is configured to be received by a user hand and comprises: a drive shaft a pair of driving elements mounted on said driveshaft, with each said driving element coupled to a clutching device, that engages the driveshaft and oriented the same on the driveshaft, so that the driveshaft is always entrained in only one direction of axial rotation; wherein when one of the driving elements is rotated in that direction, while the driveshaft is overrun by the other driving element rotated in the opposite direction; a reversing element, configured to simultaneously attach with each of said pair of driving elements together and causes them to always rotate in opposite directions, so that one driving element entrains the driveshaft and the other driving element overrides the driveshaft, thus causing the driveshaft to always rotate axially, in only one direction, regardless of the direction of rotation of the driving elements.

An inline rotation handle element positioned along the axis of said shaft, coaxially disposed at the posterior end; a collar to enclose and support said reversing element and said invertible gear-train system, with said collar being selectively allowed to rotate axially as required, for conventional ratcheting mode or, become mechanically immobile into axially non-rotation mode, for activation of the alternating engagement with and disengagement from said drive shaft of the two driving elements, without the use of either of user's hands; an anti-axial-rotation means for collar and the reversing element, coupled to collar, from rotating axially, whether device is held in horizontal or vertical position, in order to activate said dual-drive mechanism, while user's opposite hand applies clockwise and counterclockwise axial rotations alternatingly, to said inline rotation means or input handle, with said anti-axial-rotation means able to be disengaged from collar as required, to allow collar to rotate axially, thereby enabling a conventional ratcheting mode and engaged with collar as required, to immobilize the axial rotation of collar and activate the double-drive mechanism, involving alternating engagement with and disengagement from said two driving elements, with said drive shaft, without the use of either of user's hands.

An invertible speed-increaser gear-train for efficiency and speed reducer for high-torque requirements and easily accessed from exterior of tool; a switching means for changing the direction of axial rotation of driveshaft, from clockwise to counterclockwise and counterclockwise to clockwise; a locking means to retain driveshaft into clockwise rotational mode and counterclockwise rotational mode; a posterior housing for enclosing posterior driving element and an anterior housing for enclosing anterior driving element and said switching means.

In another variant, the anti-axial-rotation means is a frictionless ball bearing assembly comprised of outer race, set of metal spheres, an inner race and a hub, mounted onto and fastened with set screw, to drive shaft, with the exterior surface of outer race of said bearing assembly serving as an anchor for clamp assembly, comprising a lever, torsion spring and base, with its base being fastened to the exterior surface of outer race of said frictionless ball bearing assembly with fastener and with the clamping end of lever, bearing against exterior surface of Collar to prevent axial rotation of Collar, thereby enabling the single-handed activation of dual-drive feature, while input handle is coupled to hub and inner race of ball bearing, to cause the forward and reverse rotation of the drive shaft, without axially rotating the now-immobile outer race.

In a further variant, the anti-axial-rotation means is a gyroscope system, which can be external to collar as illustrated, or, internal to collar, having a rotor element, freely rotatable about a fixed axle, its spin activated by a coaxial crank, that swings-out from inside handle, unfolds for axial rotation, then, folds back into handle as required, after rotor is caused to spin, with spin maintained, by a larger diameter toothed element coupled to the handle and meshing perpendicularly with a smaller diameter toothed element mounted and fixed to a first end of an axle, having a larger diameter rotational element mounted and fixed to the opposite end of said axle with said larger diameter rotational element driving a smaller diameter rotational element by a closed-ended roller chain, with said smaller sprocket mounted and fixed to a first end of a second axle, causing axle to rotate, which entrains the rollers of one-way roller clutch, which, pressed into the center bore of the rotor of the gyroscope, entrains and causes a high-speed rotation of gyroscope rotor, which resists environmental forces, that are perpendicular to its axial rotation and perpendicular to the driveshaft, thereby, maintaining the desired rotational immobility of collar independent of the gyroscope feature, the input member simultaneously activates the 2×-drive mechanism by causing the rotation of posterior driving element and its set of roller clutches which entrain drive shaft while causing rotation of reversing element which causes the rotation of anterior driving element and its set of roller clutches.

In yet another variant, the anti-axial rotation means is comprised of a first ring-shaped element, having a flat, smooth, surface, rotatably mounted perpendicular to drive shaft and coupled to and rotating with said first driving element a second ring-shaped element having a flat, smooth surface, rotatably mounted perpendicular to drive shaft and coupled to and rotating with said second driving element, which is forced to always rotate oppositely of first driving element a third element having oppositely facing flat, smooth, parallel surfaces, perpendicular to drive shaft, disposed between and maintaining sliding contact with, the flat, smooth surfaces of the oppositely rotating first and second ring-shaped elements, whereby the opposite rotations of said first and second ring-shaped elements, bearing against opposite surfaces of third element, with sliding contact, causes a rotation-cancelling effect, thereby resulting with the third element being forced to remain immobile; third element is coupled to Collar of claim 1, thereby forcing Collar to also remain stationary, thereby eliminating the need of either of user's hands to hold Collar stationary and conveniently enabling user's opposite hand to hold a work piece, while user's one hand applies axial rotation to the input handle.

In another variant, the anti-axial-rotation means is a removable weight element, that attaches to the exterior surface of collar with spring-loaded ball plungers, that are captured by detents provided through surface of collar, wherein a Removable weight element is acted upon by gravity, to prevent axial rotation of collar, thereby enabling the 2×-drive feature to be activated, by bidirectional rotation being applied to input handle with one hand, while one's opposite hand is made available for holding a workpiece; and a Removable weight element is detached as required, to obtain a conventional ratcheting and single-drive mode.

In a further variant, the anti-axial-rotation means is an inline handle disposed at the posterior end, rotatably mounted to a bracket, that serves as a bridge, that bypasses the posterior driving element and supports axle, that is mounted with a sprocket fixed at one end and the reversing element fixed to said axle's opposite end for driving the reversing element, thereby activating the 2×-drive feature single-handedly, while user's opposite hand is available for holding a workpiece; The reversing element is driven by means such as said sprockets and closed loop chain, or pulleys and a closed loop belt or gear train, driven by gear, which drives gear and sprocket, both of which are mounted onto axle.

In yet another variant, the anti-axial-rotation means is a combination of at least any two of the means.

In another variant, the anti-axial-rotation means is an output drive shaft, positioned non-concentric with the input shaft, thereby creating an offset, equal to a lever arm, to provide a required counter-force, that conveniently replaces the use of one of user's hands.

In a further variant, the anti-axial-rotation means is a concentric third shaft serving as the output and an off-take of the offset shaft, with the third shaft resting atop, but, not fastened to, the concentric input shaft, which also serves as a support and a stabilizing end-guide for the third shaft.

In yet another variant, the two driving elements are a pair of gear-driven ratchet wheels and mating pawls, a posterior set and an anterior set, that alternatingly engage with and disengage from the drive shaft, with one ratchet wheel and pawl engaged to entrain the drive shaft, while the other ratchet wheel and pawl is disengaged from and overrides the driveshaft.

In another variant, the two driving elements are two sets of gear-driven roller clutches, a posterior set and an anterior set, that alternatingly engage with and disengage from the drive shaft, with one set of roller clutches caused to engage to entrain the drive shaft while the other set of roller clutches is simultaneously caused to disengage from and override the driveshaft.

In a further variant, the invertible gear-train system is comprised of a set of different-sized gears, fixed on axles, arranged to produce an amount of rotations, that are greater at the driving end than the amount of rotations applied to the input end for speed-multiplication requirements and capable of being inverted to produce an amount of rotations at the driving end, that are less than the amount of rotations applied to the input, for higher torque requirements, is internally coupled inline with the drive shaft, with a knob provided on the external surface of collar to easily invert the gear-train as required.

In yet another variant, a secondary handle is pivotally coupled to the collar, for pivoting to parallel with driveshaft when not in use and for being pivoted to perpendicular to driveshaft for applying radial swing for leverage, stability of tool during use and preventing axial rotation of collar, when conventional ratcheting mode is required for applying finishing-torque to threaded fasteners.

In another variant, the reversing element is a gear, that, simultaneously attaches with the two driving elements and causing the two driving elements to always rotate axially, in opposite directions.

In a further variant, the anti-axial-rotation means is an adjustable two-ended tether, with one end anchored to a user such as via a belt clip, a belt loop, shoe, anchored to the ground, or to a wall or ceiling, or doorknob, while the opposite end is tautly attached to the collar to prevent its axial rotation while driving fasteners.

DETAILED DESCRIPTION OF THE EMBODIMENTS OF THE INVENTION

In a variant, referring to FIG. 1 through FIG. 9, Ball Bearing Assembly 2, comprised of Outer Race 2A, set of Ball Bearings 2B, Inner Race 2C and Hub 2D is mounted onto Hub 4A of Posterior Driving Element 4 and retained in place on said Hub 4A with Fasteners 5. Handle 1 is secured to outer surface of Hub 4A with fasteners 3. Drive-Shaft End Cap 6 is fastened to Driveshaft 7 with Fastener 8 to secure the entire assembly together from the posterior end, while Dowel 21 is pressed through bore in Switch Housing 22 and said Driveshaft 7 at the anterior end and maintain said Posterior Driving Element 4 in mesh with Reversing Element 9 and prevent Posterior Driving Element 4 and Posterior Driving Element Housing 4B, from sliding off of Driveshaft 7.

With Bidirectional Switch 10, which dictates direction of output rotation, set into position to cause solely clockwise output rotation mode, clockwise axial rotation applied to Handle 1 causes Hub 2D and Posterior Driving Element 4 to rotate clockwise, while Posterior Set of Roller Clutches 11 are caused to wedge between surface of Driveshaft 7 and inner surface of bore of Posterior Driving Element 4, causing Posterior Driving Element 4 to entrain Driveshaft 7 in clockwise rotation, while simultaneously causing Reversing Element 9, which rotates freely about Axle 23 which is secured in place with fastener 24, to rotate axially in clockwise direction, causing Anterior Drive Element 12 to rotate axially in counterclockwise direction to override Anterior Set Roller Clutches 14.

With Bidirectional Switch 10, still set to solely clockwise output rotation mode, counterclockwise axial rotation applied to handle 1 causes Hub 2D and Posterior Driving Element 4 to rotate counterclockwise and override Posterior Set of Roller Clutches 11 while causing Anterior Set of Roller Clutches 14 to become wedged between inner surface of Anterior Drive Element 12 and surface of Driveshaft 7 thereby entraining Anterior Drive Element Housing 12A, Switch Housing 22 and Driveshaft 7 in clockwise rotation.

Conversely, with Bidirectional Switch 10 set to solely counterclockwise output rotation mode, the same components listed previously are caused to cooperate in the same manner, for solely counterclockwise output rotation.

Figure 1:
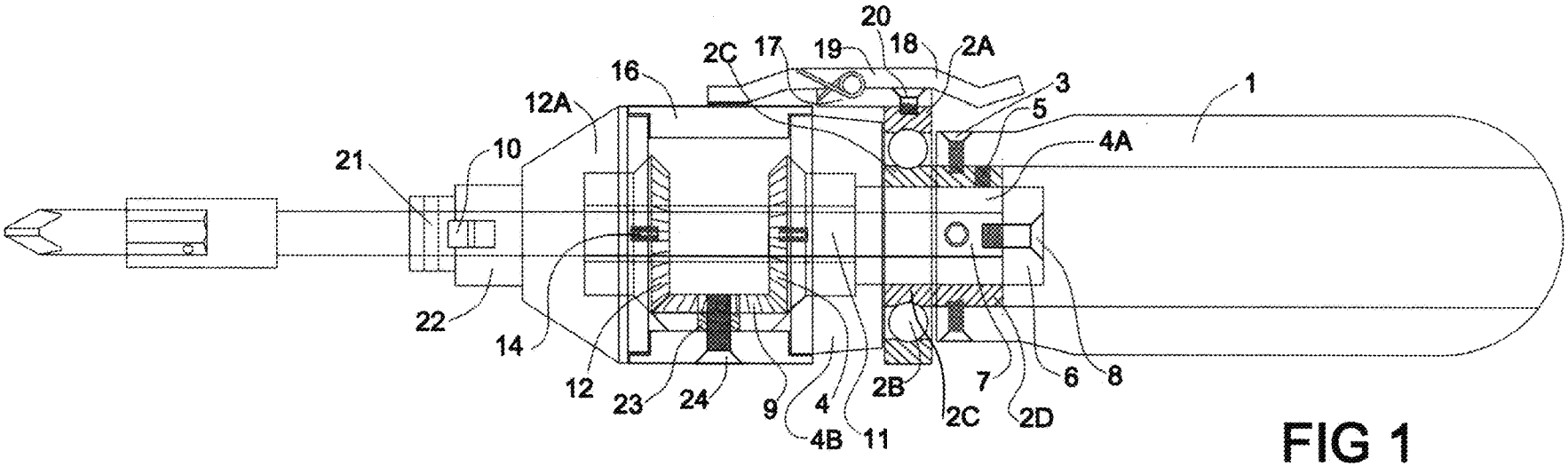
FIG. 1 is a side view of a dual-drive manual screwdriver.
Figure 2:
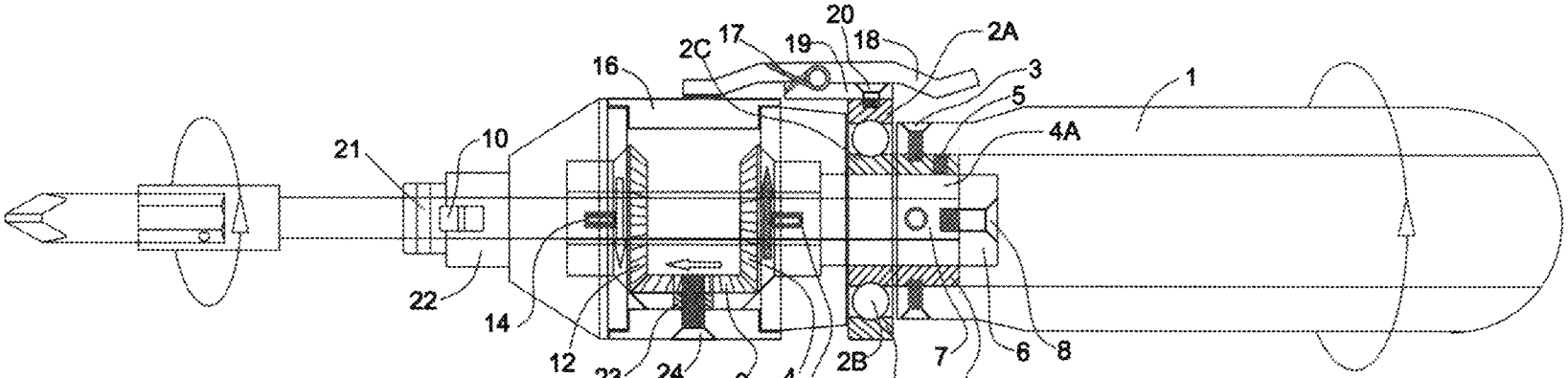
FIGS. 2-10 are various embodiments and configurations of the dual-drive manual screwdriver.

Referring to FIG. 2, a bidirectional switch 10 set to forward position to cause clockwise output rotation and the rotational analysis of driving and overriding components as clockwise axial rotation is applied to the input handle, while the Clamping Device 18 is shown bearing against the outer surface of Collar 16 to prevent its axial rotation, thereby enabling user's opposite hand to be conveniently available for securing a work piece.

Figure 3:
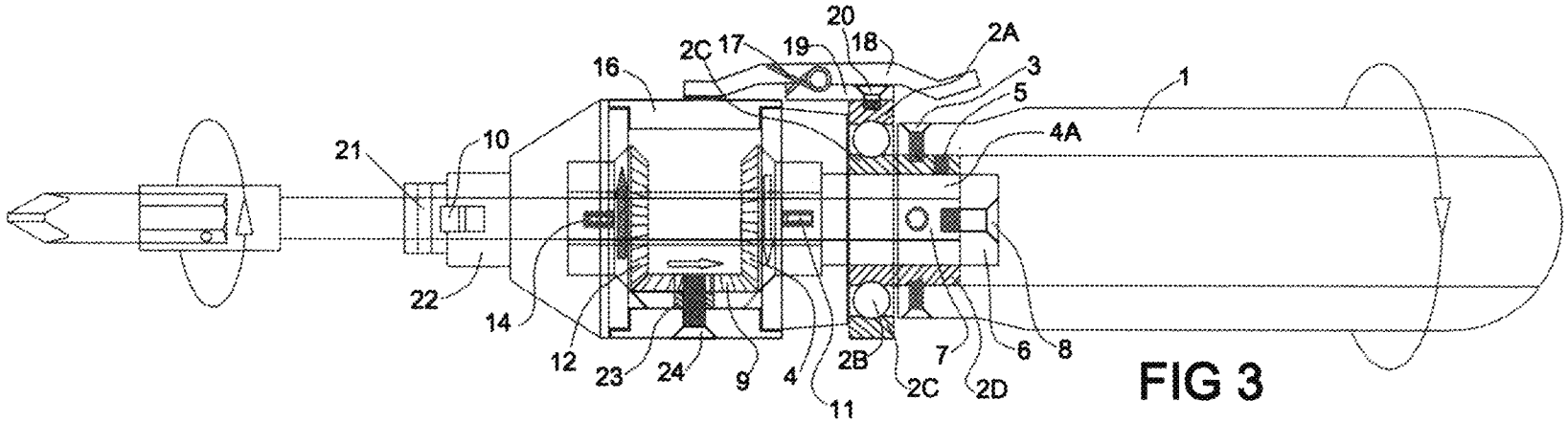

Referring to FIG. 3, shows a bidirectional switch 10 still set to forward position to cause continued clockwise output rotation as FIG. 2 and illustrates the rotational analysis of driving and overriding components, as counterclockwise axial rotation is applied to the input handle, while the Clamping Device 18, is shown bearing against the outer surface of Collar to prevent its axial rotation, thereby enabling user's opposite hand to be available for securing a work piece.

Figure 4:
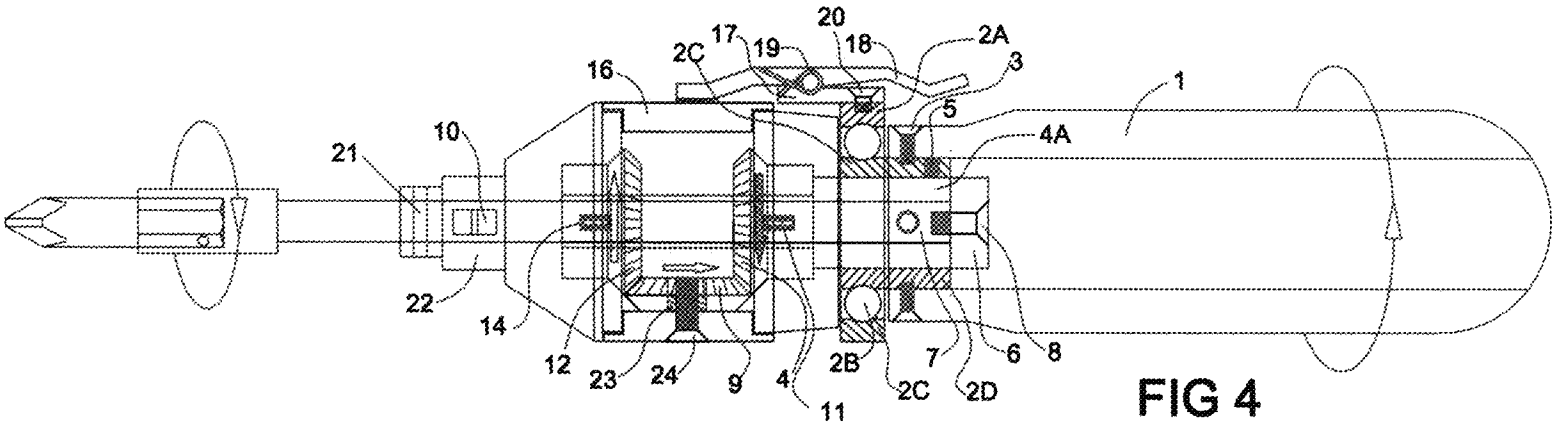

Referring to FIG. 4, the bidirectional switch 10 set to reverse position to cause counterclockwise output rotation and illustrates the rotational analysis of driving and overriding components as counterclockwise axial rotation is applied to the input handle, while the Clamping Device 18 is shown bearing against the outer surface of Collar 16 to prevent its axial rotation, thereby enabling user's opposite hand to be conveniently available for securing a work piece.

Figure 5:
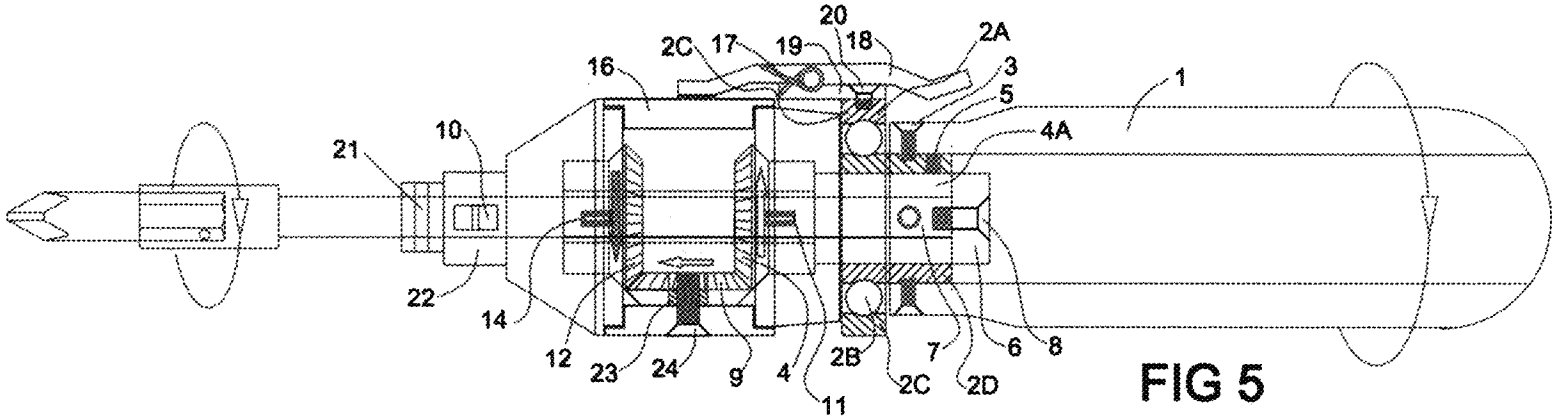

Referring to FIG. 5, the bidirectional switch 10 still set to reverse position to cause continued counterclockwise output rotation and illustrates the rotational analysis of driving and overriding components as clockwise axial rotation is applied to the input handle, while the anterior end of Clamping Device 18 is shown bearing against the outer surface of Collar 16 to prevent its axial rotation, thereby enabling user's opposite hand to be conveniently available for securing a work piece.

Figure 6:
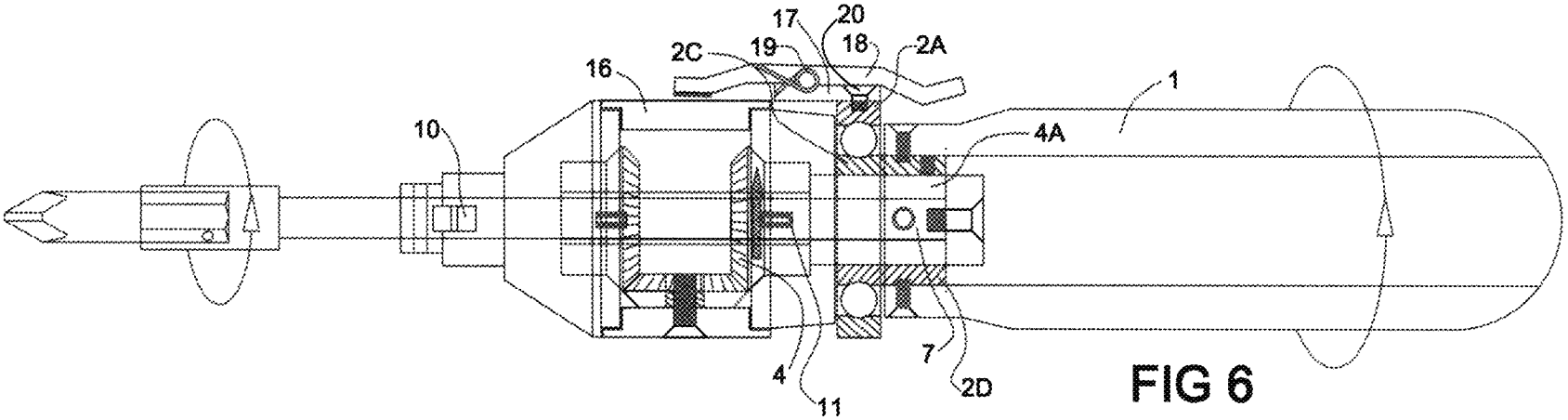

Referring to FIG. 6, the bidirectional switch 10 set to forward position to cause clockwise output rotation of the Driveshaft 7, while posterior end of Clamping Device [Lever] 18 is depressed, thereby preventing anterior end of Lever from bearing against the outer surface of Collar 16, thereby allowing Collar 16 to rotate axially, to enable device to be utilized in conventional ratcheting mode in clockwise output direction.

Figure 7:
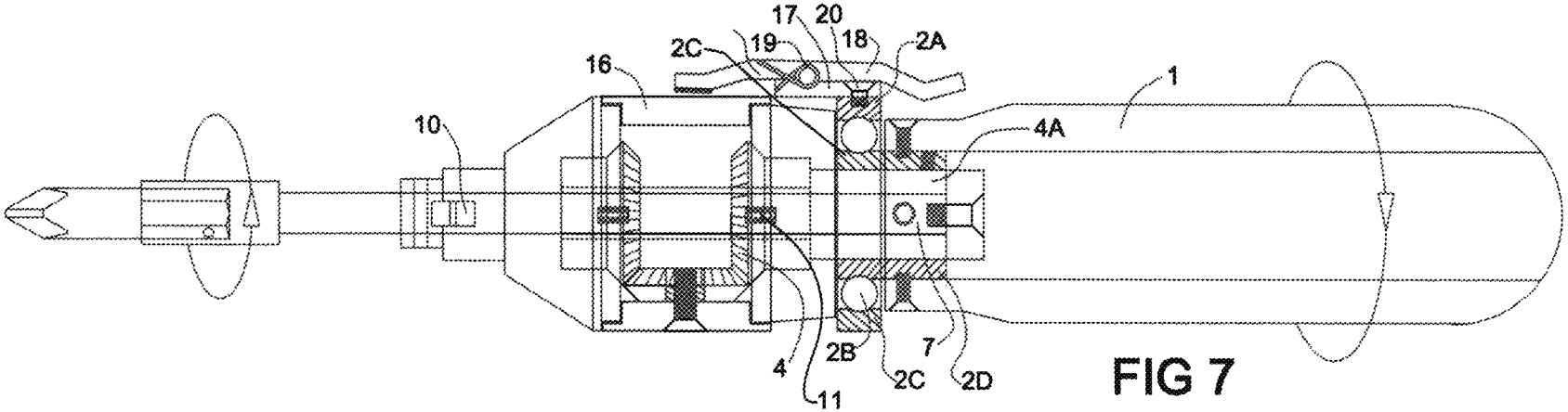

Referring to FIG. 7, the Bidirectional Switch 10 set to reverse position to cause counterclockwise output rotation of the Driveshaft 7, while posterior end of Clamping Device Lever 18 is depressed, thereby preventing anterior end of Clamping Lever 18 from bearing against the outer surface of Collar 16, thereby allowing Collar 16 to rotate axially, to enable device to be utilized in conventional ratcheting mode in counterclockwise output direction.

Figure 8:
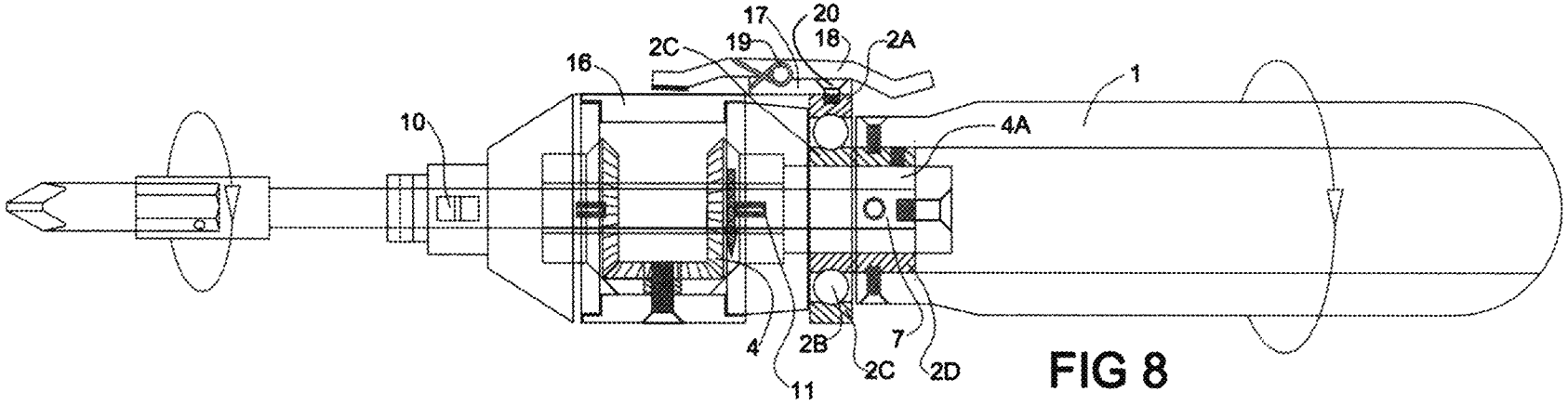

Referring to FIG. 8, the Anterior End of Clamping Device Lever 18 lifted from surface of Collar 16, to allow collar to rotate, in order for the device to function in a conventional ratcheting mode in the clockwise output direction.

Figure 9:
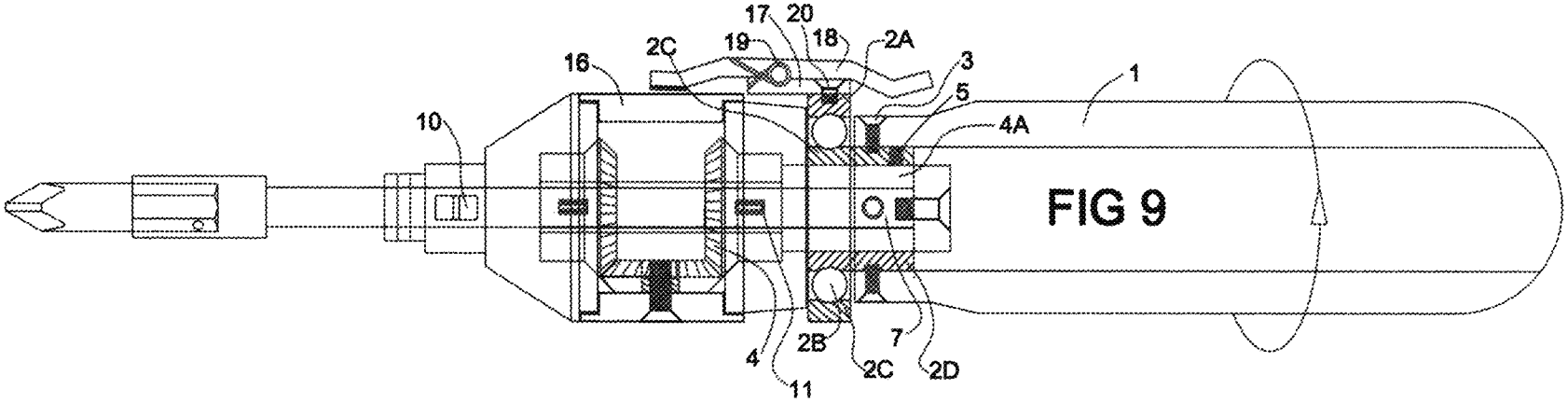

Referring to FIG. 9, the Bidirectional Switch 10 in reverse position and the Anterior End of Lever of the Clamping Device 18, lifted and not bearing against the outer surface of Collar 16, thereby allowing Collar 16 to rotate axially, to enable device to be utilized in a conventional ratcheting action, but, in ratcheting-up mode, in preparation for a counterclockwise output direction.

The cooperation of the function of each component listed above to achieve the 2×-drive feature single-handedly, can only occur with the Anterior End of Lever 15 bearing against the outside surface of Collar 16 to prevent the axial rotation of Collar. A user can thereby single-handedly activate the featured 2×-drive action, while user's opposite hand is conveniently free to hold a workpiece stationary.

In another variant, a Spring-loaded clamp is comprised of a base 17, a lever 18 and a Torsion Spring 19, that forces Base 17, and Lever 18 in contact with each other. Clamp Base 17 is anchored to outer surface of Ball Bearing Race 2A with Fastener 20. Torsion Spring 19 causes Anterior End of Lever 18 to bear against outer surface of Collar 16 to prevent axial rotation of Collar 16, while Base 17 of clamp is anchored to the immobilized Outer Race 2A of Ball Bearing.

Conversely, with the mechanism, set to counterclockwise output rotation mode, counterclockwise axial rotation, applied to Handle 1 causes Hub 4 of Ball Bearing 2 and Posterior Driving Element to rotate clockwise, while Posterior Set of Roller Clutches are caused to wedge between Driveshaft surface and surface of bore of Posterior Driving Element causing Clutches to entrain Driveshaft in clockwise rotation, while simultaneously causing Reversing Element to rotate axially in clockwise direction, causing Anterior Drive Element to rotate axially in counterclockwise direction to override a set of Anterior Roller Clutches.

In a further variant, a Spring-loaded clamp is comprised of a base 9, a lever 10 and a Torsion Spring 11, that forces base and lever into contact with each other. Clamp base 9 is secured to surface of Outer Race 12 with fastener 14. Torsion Spring 11 causes anterior end of Lever 10 to bear against outer surface of Housing 15 to prevent axial rotation of Housing, thereby, activating the 2×-drive mechanism without the use of either of user's hands to retain Housing immobile from axial rotation. The simultaneous bearing down of Clamp Lever onto surface of Housing and the anchoring of Base 9 to Outer Race of ball bearing, immobilizes Outer Race of ball bearing. Whereas, forcing the posterior end of Lever 10 down, lifts the anterior end of Lever 10 from the surface of Outer Race 12 to allow Housing to rotate axially to achieve a conventional ratcheting mode for added torque to seat fasteners securely.

In yet another variant, referring to FIG. 10 through FIG. 22A, a configuration of the internal components of one means to prevent the collar 16 from rotating axially, thereby activating the dual-drive feature, including a center core 5, coupled to said collar 16, being caused, along with collar 16, to remain immobile due to smooth, parallel and flat-surfaced elements 4 and 7, simultaneously bearing against and rotating in opposite directions, on opposite flat-surface faces of said core 5, thereby cancelling the tendency of core to rotate axially in either direction.

Figure 10:
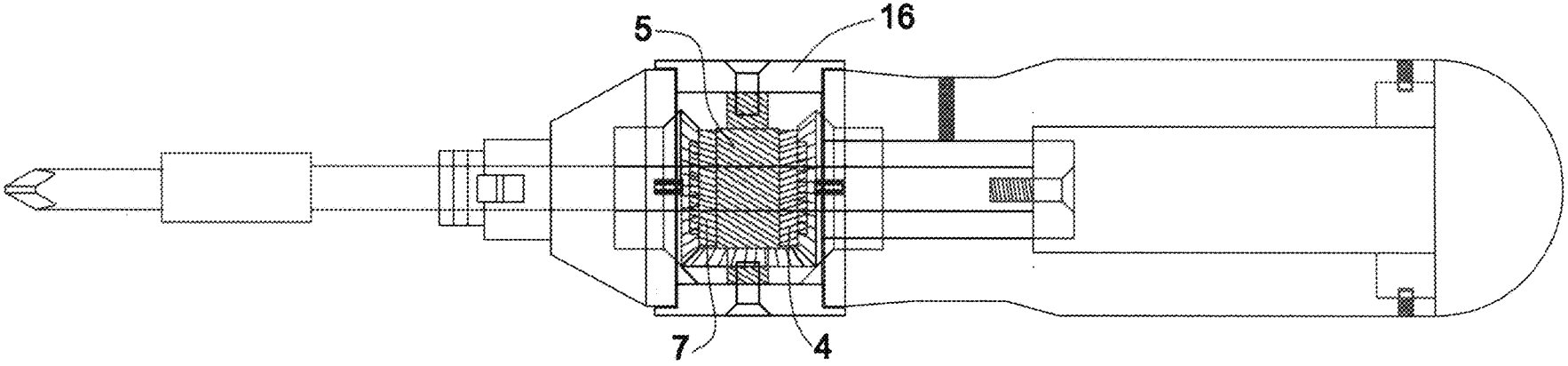
Figure 11:
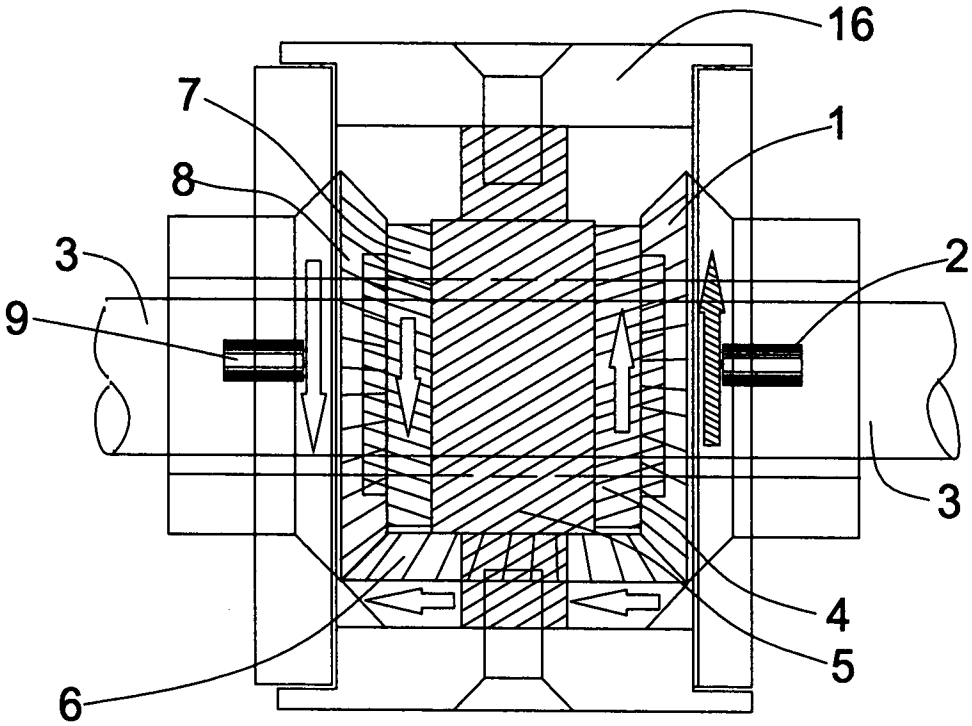
FIG. 11 is a view of the internal components of FIG. 10.

Referring to FIG. 11, a rotation analysis of the internal components of FIG. 10. Collar 16 and center core 5, coupled together, remain immobile as elements 4 and 7 on either side of core, rotate oppositely against core 5 to cancel the tendency of core 5 to rotate axially in either direction. Smooth and flat-surfaced element 7 is coupled to and rotates CCW with anterior driving element while bearing against and rotating CCW with flat and smooth-surfaced core 5, with sliding contact. Anterior driving element 8 and set of roller clutches 9, override driveshaft in CCW rotation. Reversing element 6 is caused to rotate axially CCW. CW axial rotation is applied to posterior driving element 1 causing set of rollers 2, to clutch and entrain driveshaft 3 in CW axial rotation. Elements 4 and 7 bear against and rotate oppositely on either side of core 5, thereby cancelling rotation tendency of core whereby, core and collar 10, coupled together, remain stationary in order to activate the 2×-drive feature without either of users' hands. Smooth and flat-surfaced element 4, is coupled to and rotates with posterior driving element 1, while bearing and rotating CW against flat and smooth-surfaced core 5, with sliding contact.

Figure 12:
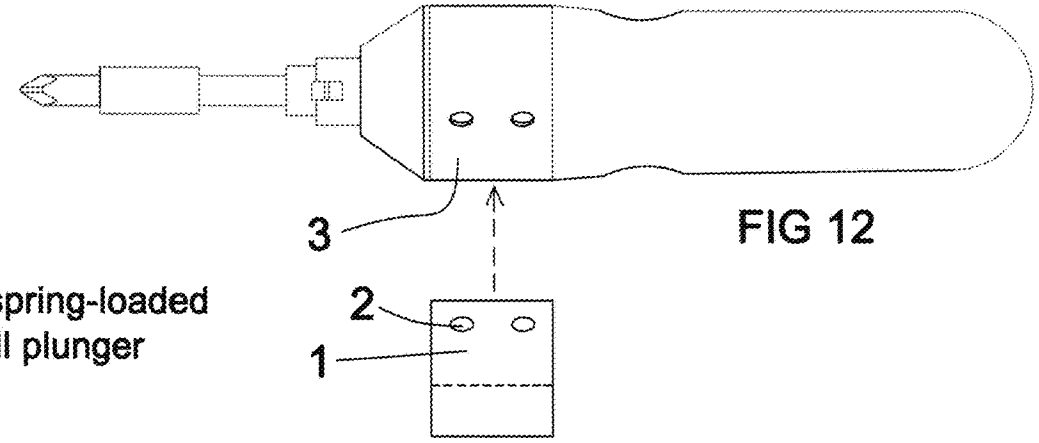
FIG. 12 is a side view of a weighted attachment prior to attachment to a collar.

Referring to FIG. 12, a weighted attachment 1 prepared to be attached to Collar 3. Without the weighted element attached to prevent axial rotation of the collar 3, the screwdriver is operated simply as a conventional ratcheting screwdriver and not a dual-drive.

Figure 13:
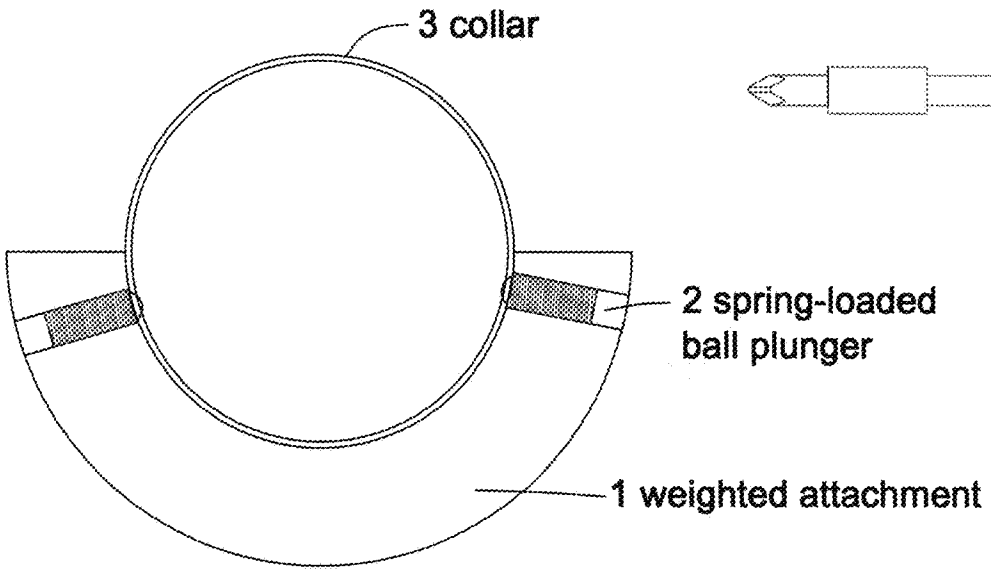
FIG. 13 is a sectional view of the weighted element mounted to a collar and retained in place with spring-loaded ball plungers.

Referring to FIG. 13, a sectional view of the weighted element mounted to collar 3 and retained in place with spring-loaded ball plungers 2.

Figure 14:
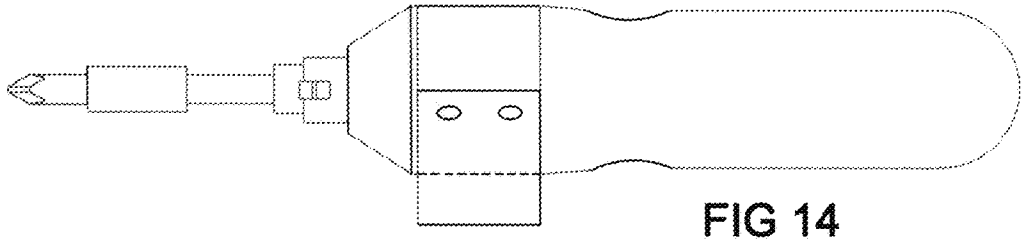
FIG. 14 is a side view of a weighted element attached to a collar.

Referring to FIG. 14, a weighted element 1 attached to Collar 3 and preventing said Collar 3 from rotating axially, acted on by density, thus causing weighted attachment 1 to cause Collar 3 to be just weighty enough to remain immobilized, by exceeding the axial turning force applied to the input handle, the internal friction of mechanism and the resistance of the material in which a tapered thread screw is being driven, thereby activating the dual-drive feature without the use of user's either hand.

Figure 15:
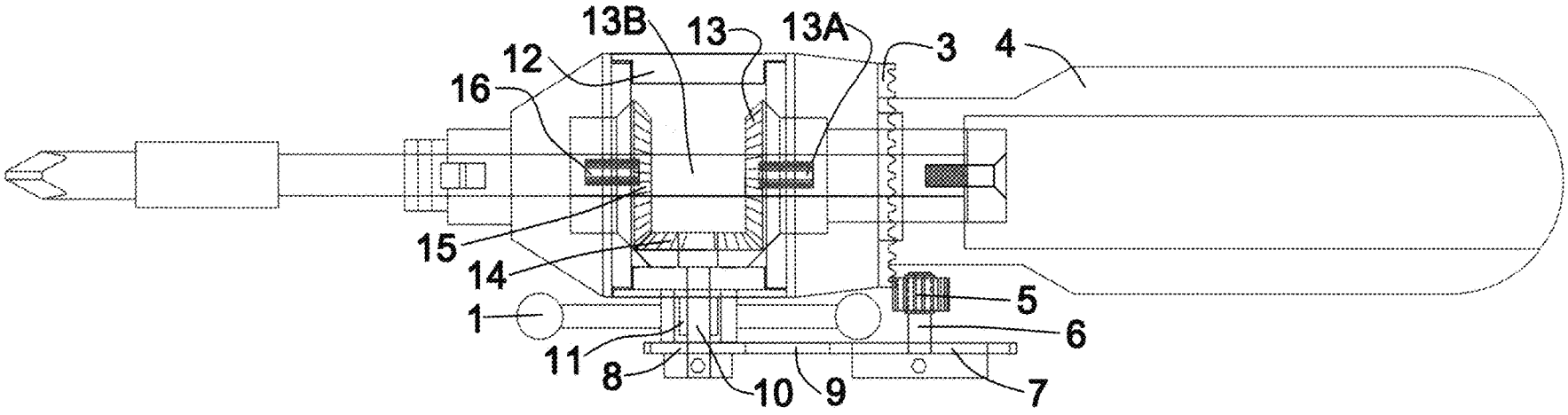
FIGS. 15-22A are embodiments of the dual-drive manual screwdriver.

Referring to FIG. 15, an alternative means to prevent collar 12 from axial rotation, using a gyroscope system. Axial rotation is applied to handle 4, causing crown gear 3 to rotate, which causes spur gear 5, fixed to axle 6, to rotate, causing larger sprocket 7, fixed to axle 6, to rotate, causing smaller sprocket 8, fixed to axle 10 to rotate. Roller chain 9 connects sprockets 7 and 8 and causes them to rotate in same direction. Axle 10 entrains roller clutch 11 into high-speed rotation. Roller clutch 11 being pressed into center bore of rotor 1, forces rotor 1 into high-speed rotation, which causes rotor to resist forces perpendicular to its axis of rotation, thereby immobilizing collar 12, from axial rotation in either direction, in order to activate the dual-drive feature without the use of either of user's hands, because rotor is coupled to the collar. Clockwise axial rotation applied to handle 1, simultaneously, causes the activation of two separate systems; the gyroscope mechanism as previously described and the dual-drive mechanism. Clockwise axial rotation applied to handle 1, which is coupled to the hub of posterior driving element 2, causes posterior driving element 2 to rotate axially in clockwise direction, causing reversing element 3 to rotate clockwise, causing anterior driving element 4 to rotate axially in counterclockwise direction to override driveshaft.

Figure 16:
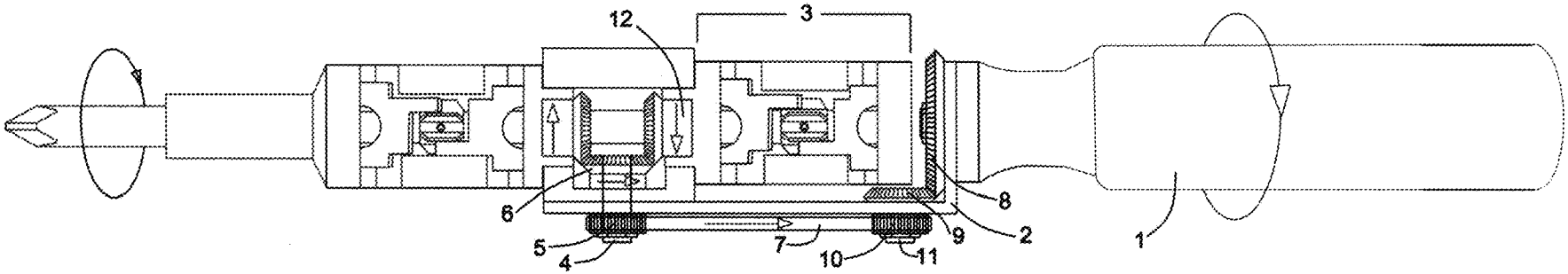

Referring to FIG. 16, an alternate means to prevent axial rotation of collar; handle 1 is inline and rotationally coupled to bracket 2, which by-passes the posterior driving gear 12 and transfers handle rotation to the reversing element 6, with pulleys and belt, or sprockets and chain, sprockets and toothed belt, or gear train. Rotation applied to handle 1 causes larger miter gear ring 8 to rotate, which causes sprocket 10, fixed to axle 11, to rotate, which causes sprocket 5, fixed to axle 4, to rotate, causing reversing miter gear 6 to rotate. Belt 7 with internal teeth meshes with sprockets 5 and 10 to cause their same direction of rotation.

Figure 17:
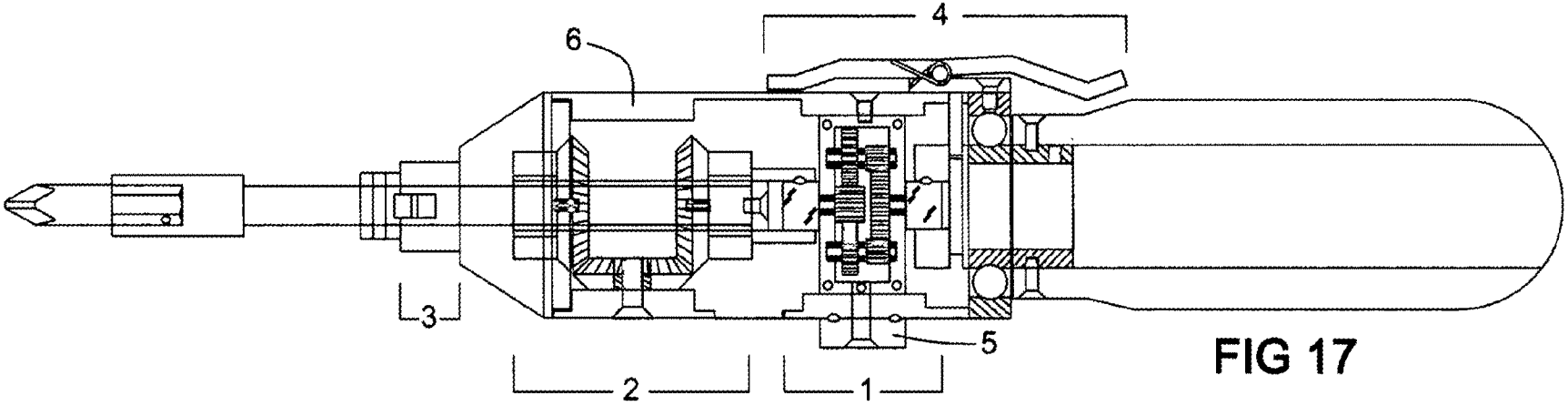

Referring to FIG. 17, a clamping means, in bracketed-section 3, bearing against the outer surface of Collar 6, to immobilize collar 6, thereby activating the dual-drive gear-train in bracketed-section 2 and an invertible gear-train in bracketed-section 1, shown positioned for speed-reduction for added torque, whereby the number of rotations at the output is less than the amount of rotations applied to the input. Finger wheel 5 inverts gear train from exterior.

Figure 18:
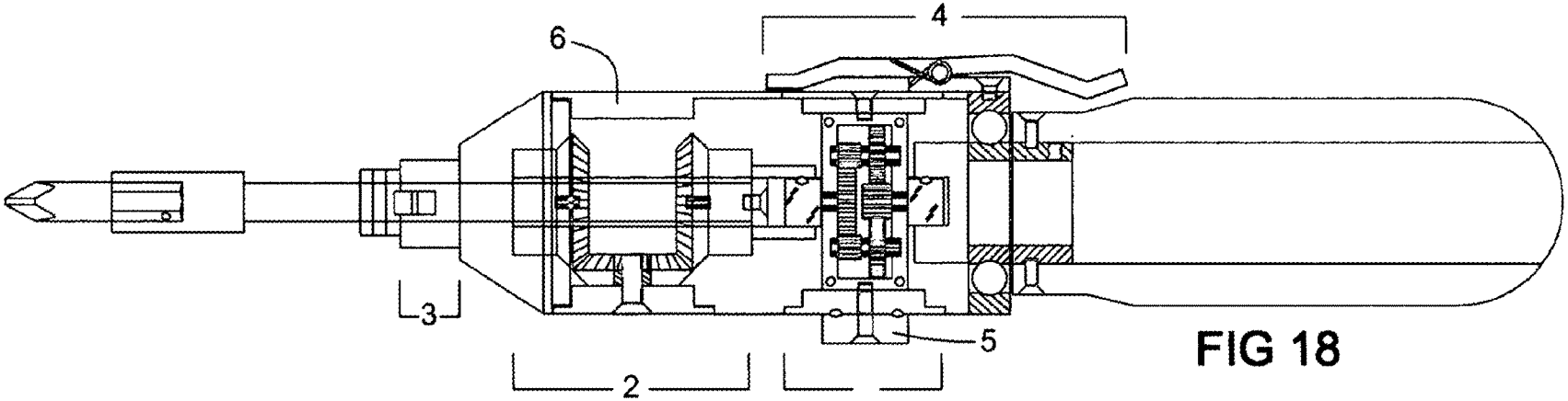

Referring to FIG. 18, a clamping means, in bracketed-section 3, bearing against the outer surface of Collar 6, to immobilize collar 6, thereby activating the dual-drive gear-train in bracketed-section 2 and an invertible gear-train in bracketed-section 1, shown positioned for speed-multiplication for efficiency, whereby the number of rotations at the output exceeds the number of rotations applied to the input. Finger wheel 5 inverts gear train from exterior.

Figure 18A:
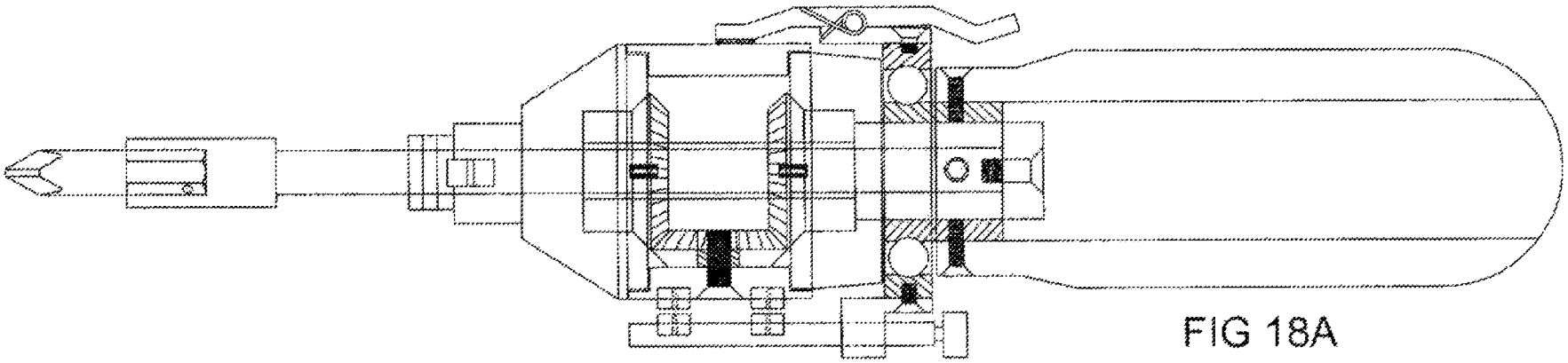

Referring to FIGS. 18A, 18B and 18C, an alternative means for activating the double-drive mechanism hands-free, while a user's one hand applies oscillation-motion to the input handle and the opposite hand conveniently holds a work piece stationary. FIG. 18A is a view of the driving end of hand tool, without the housing.

The output drive shaft is positioned non-concentric with the input handle, thereby creating an offset, equal to a lever arm, to provide a required counter-force, that replaces the use of one of user's hands. Assigning real-world values such as 1 Nm input torque and 1 Nm load at the output, an equilibrium equation is constructed, which is a requirement for the reversing the direction; 1 Nm [the input torque]+1 Nm [the load at output]+x [the required counter-balance force, that must be determined]=0. Solving this equation reveals, that the x is required to be equal to −2 Nm.

Hence, to reverse the direction, 'x', (environmental torque of −2 Nm) is required to act on the system. Environmental torque, that is not being supplied from the input handle nor the output shafts, but from another source, such as, that, provided by one of user's hands, which is an inconvenience and not recommended, because, a user's second hand should be available for holding a work piece stationary and not occupied with immobilizing the double-drive feature of the tool.

In another variant, an offset mechanism is required and must be positioned between the input handle and the output shaft. Due to their non-concentricity, the −2 Nm torque is achieved through the "arm of a lever" which is represented by the offset distance between the output shaft and the input shaft. If the offset is not present, the needed −2 Nm for the reverse of the rotation direction are also not present. These missing −2 Nm would cause the casing of the gearwheels to axially rotate freely around the output, while there is no torque transmitted to the output. Hence, when rotating the input, the casing is rotating freely while the output is immobile.

When the offset is not present, the collar must be anchored to an inertial frame of reference to get −2 Nm from there. An inertial frame of reference can be the hand of the user, the ground or something that is immobile and rigid enough to resist −2 Nm. None of these are desirable, nor practical, hence, the offset mechanism is a solution. FIG. 18B is a side view of the offset mechanism. FIG. 18C is a side view of an alternative arrangement of the mechanism, having a third shaft, which is an off-take of the offset shaft, with the third shaft resting atop, but, not fastened to the input shaft, which serves as a support and a stabilizing guide for the third shaft, which is concentric with input handle for direct force from the posterior.

Figure 19:
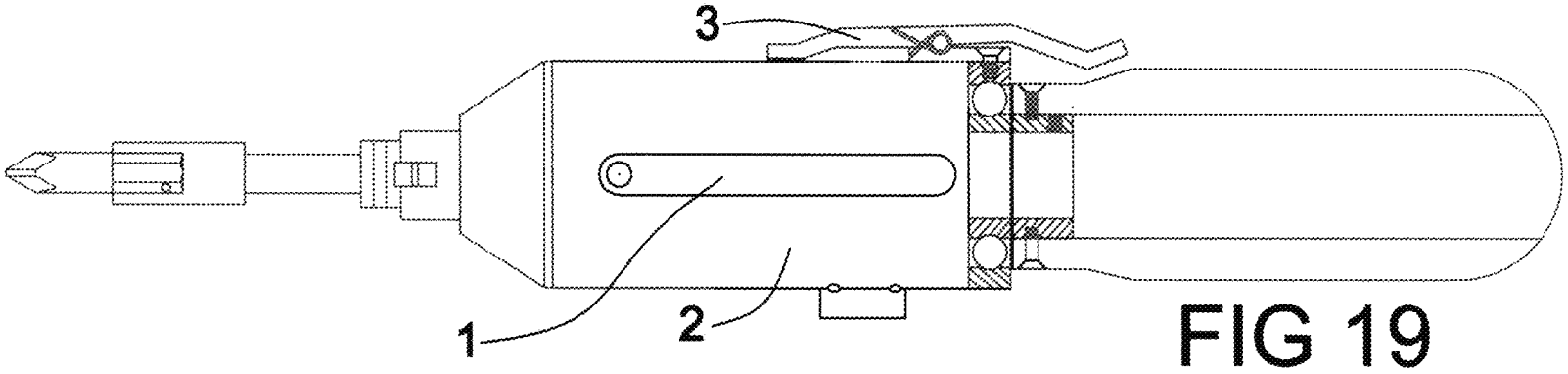

Referring to FIG. 19, a secondary handle 1, pivotally-coupled to the outside surface of collar 2 and parallel with driveshaft when not in use. Clamping device 3 is engaged with surface of collar to prevent axial rotation of collar, in order to activate the dual-drive feature without using either of user's hands.

Figure 20:
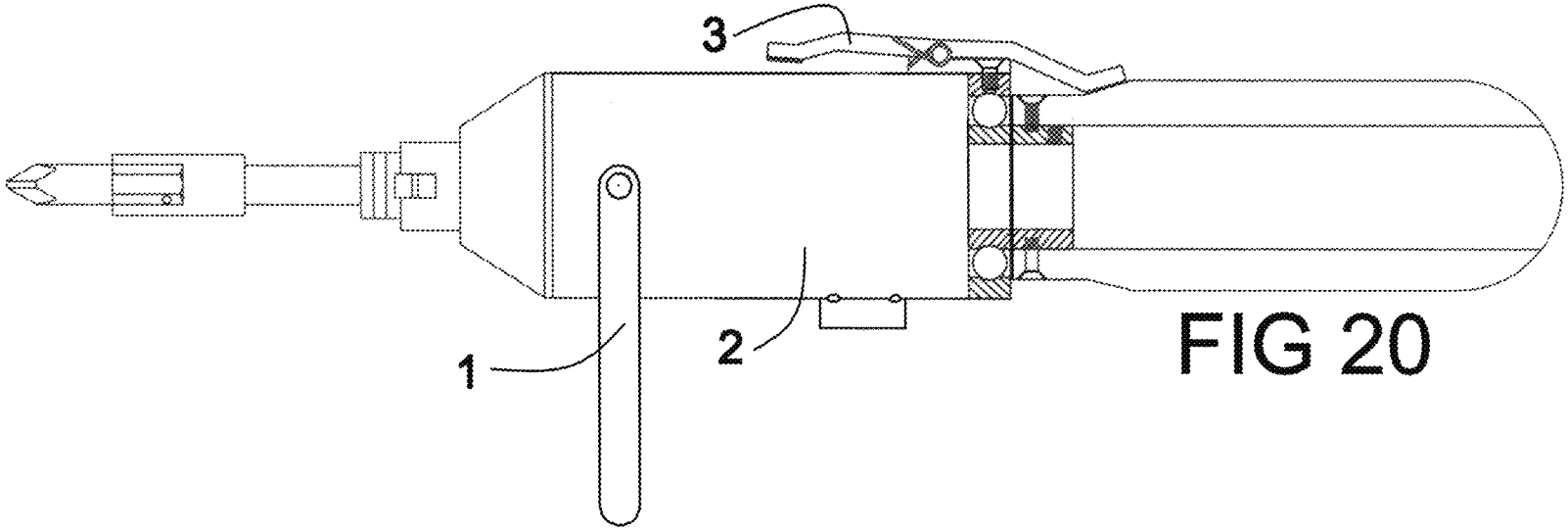

Referring to FIG. 20, the secondary handle 1, pivoted to perpendicular to the drive shaft, for being swung radially for leverage, to cause the overall device to function in conventional ratcheting mode to apply finishing-torque. The anterior end of lever of the clamping device 3 is shown disengaged from collar 2 to enable secondary handle 1 to swing radially for conventional ratchet action.

Figure 21:
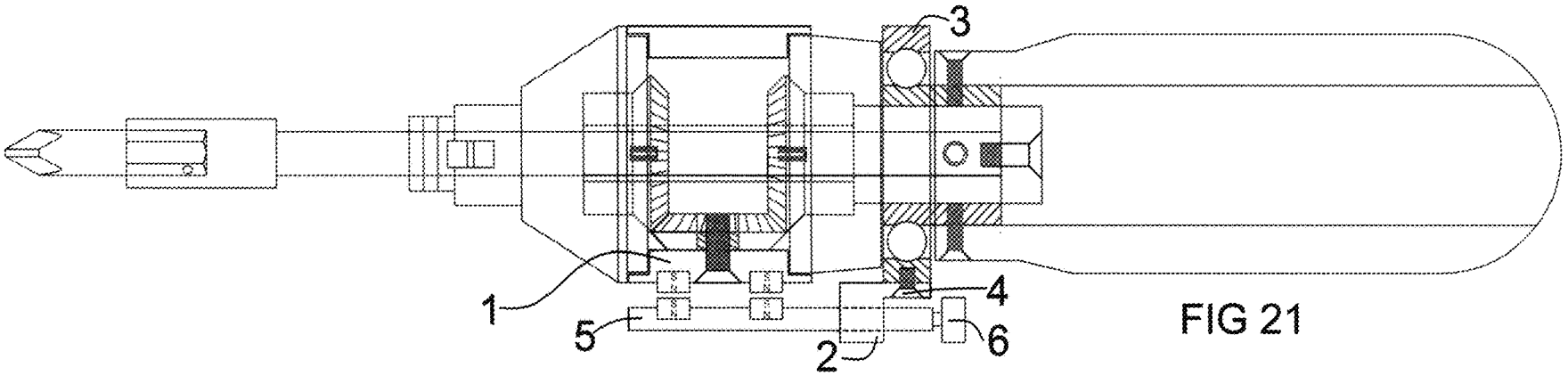

Referring to FIG. 21, the axial rotation of collar 1 is prevented by bracket 2 being fastened with hardware 4 to outer-race of roller-bearing 3; rod 5 passes through bracket 2 and retained in-place by clips 5A and 5B and fitted with magnets 7 and 8, that are attracted by magnets fitted into collar 1 to keep collar 1 from rotating Finger wheel 6 is rotated 180 degrees to break magnetic attraction and allow collar 1 to rotate as required.

Figure 21A:
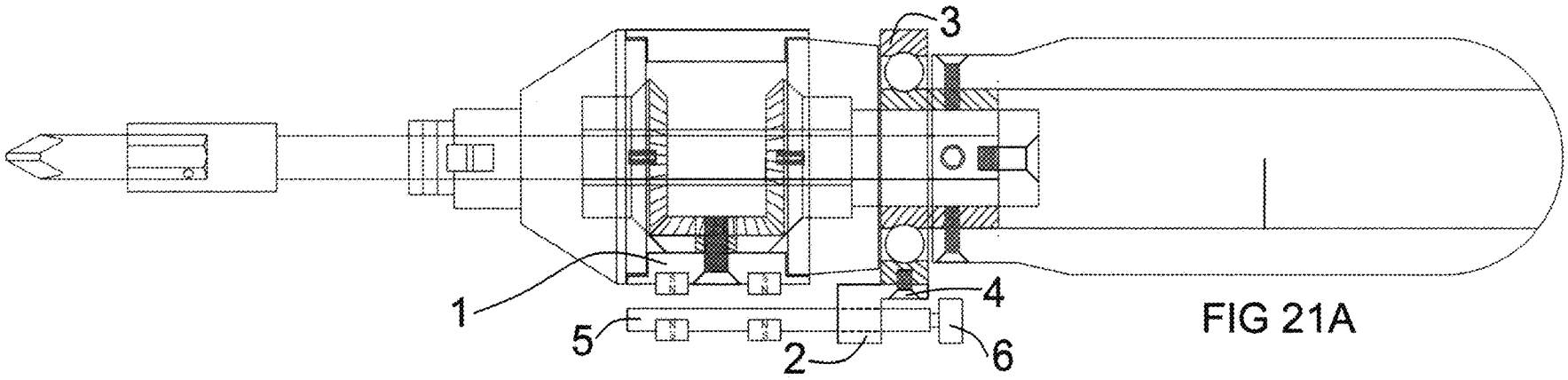

Referring to FIG. 21A, the rod is turned 180 degrees to set magnets out of attraction from magnets fitted to collar 1, to allow collar 1 to rotate as required.

Figure 22:
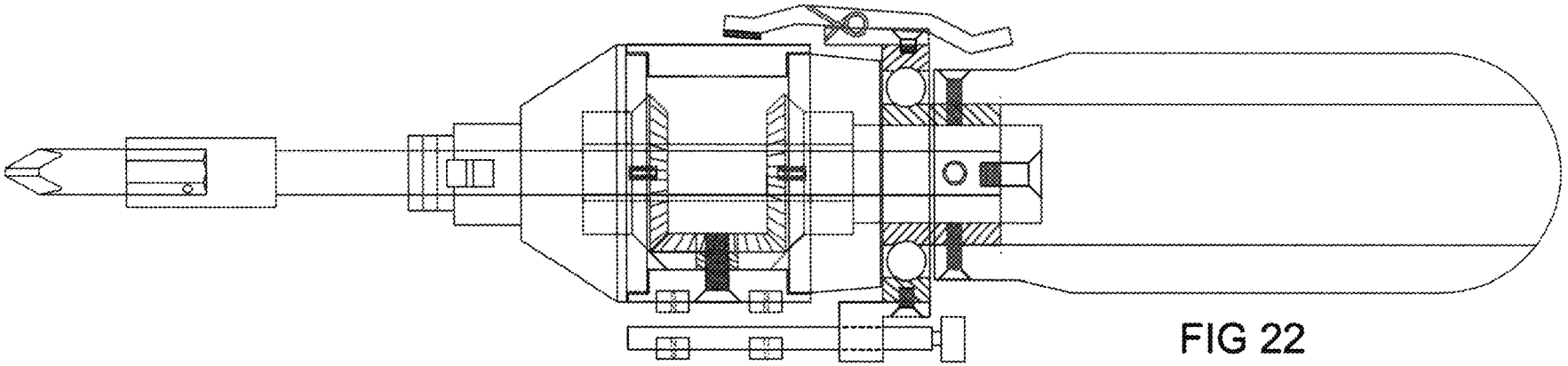

Referring to FIG. 22, a combination of at least two of the several means are configured to prevent axial rotation of the collar. The two separate means, shown disengaged from the collar to allow collar to rotate axially to cause a conventional ratcheting mode are a clamping device and magnetic system.

Figure 22A:
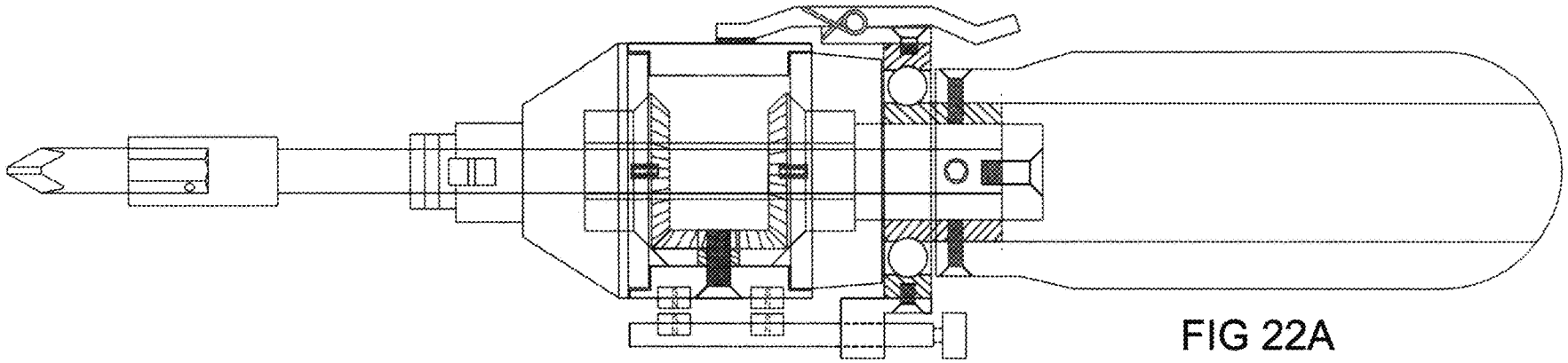

Referring to FIG. 22A, an exemplification of the combination of at least two of the several means to prevent axial rotation of the collar. The two separate means, shown engaged with the collar to prevent its axial rotation in order to activate the dual-drive feature, without the use of either of the user's hands, are a clamping device and magnetic system.

I claim:

1. A dual-drive mechanism system, configured to be set to a clockwise rotational output mode and to convert oscillatory axial motion applied to its input, into solely clockwise rotation motion at its output; further configured to be set to a counterclockwise rotational output mode and to convert oscillatory axial motion applied to its input, into solely counter-clockwise rotation motion at its output, comprising:

an in-line input-handle configuration, featuring a means configured to immobilize the axial rotation of collar without the use of either of user's hands, while user applies clockwise and counter-clockwise axial rotation to the input handle at the posterior end, thereby enabling user to activate the 2×-drive feature and an invertible gear-train;

wherein one output is configured to multiply rotational speed, while the opposite output reduces speed, single-handedly;

wherein a work piece is configured to be received by a user hand and comprises: a drive shaft; a pair of driving elements mounted on said driveshaft, with each said driving element coupled to a clutching device, that engages the driveshaft and oriented the same on the driveshaft, so that the driveshaft is always entrained in only one direction of axial rotation;

wherein when one of the driving elements is rotated in that direction, while the driveshaft is overrun by the other driving element rotated in the opposite direction;

a reversing element, configured to simultaneously attach with each of said pair of driving elements together and causes them to always rotate in opposite directions, so that one driving element entrains the driveshaft and the other driving element overrides the driveshaft, thus causing the driveshaft to always rotate axially, in only one direction, regardless of the direction of rotation of the driving elements;

an inline rotation handle element positioned along the axis of said shaft, coaxially disposed at the posterior end;

a collar to enclose and support said reversing element and said invertible gear-train system, with said collar being selectively allowed to rotate axially as required, for conventional ratcheting mode or, become mechanically immobile into axially non-rotation mode, for activation of the alternating engagement with and disengagement from said drive shaft of the two driving elements, without the use of either of user's hands;

an anti-axial-rotation means for the collar and the reversing element, coupled to the collar, configured to prevent the collar from rotating axially, whether the system is held in horizontal or vertical position, in order to activate said dual-drive mechanism, while a user's opposite hand applies clockwise and counterclockwise axial rotations alternatingly, to said inline rotation means or input handle, with said anti-axial-rotation means able to be disengaged from the collar as required, to allow the collar to rotate axially, thereby enabling a conventional ratcheting mode and engaged with the collar, to immobilize the axial rotation of the collar and activate the double-drive mechanism, involving alternating engagement with and disengagement from said two driving elements, with said drive shaft, without the use of either of a user's hands;

an invertible speed-increaser gear-train for efficiency and speed reducer for high-torque requirements and easily accessed from an exterior of the system;

a switching means for changing the direction of axial rotation of driveshaft, from clockwise to counterclockwise and counterclockwise to clockwise;

a locking means to retain driveshaft into clockwise rotational mode and counterclockwise rotational mode;

a posterior housing for enclosing a posterior driving element; and an anterior housing for enclosing a anterior driving element and said switching means.

2. The dual-drive mechanism system of claim 1, wherein the anti-axial-rotation means is a frictionless ball bearing assembly comprised of outer race, set of metal spheres, an inner race and a hub, mounted onto and fastened with set screw, to drive shaft, with the exterior surface of outer race of said bearing assembly serving as an anchor for clamp assembly, comprising a lever, torsion spring and base, with its base being fastened to the exterior surface of outer race of said frictionless ball bearing assembly with fastener and with the clamping end of lever, bearing against exterior surface of Collar to prevent axial rotation of Collar, thereby enabling the single-handed activation of dual-drive feature, while input handle is coupled to hub and inner race of ball bearing, to cause the forward and reverse rotation of the drive shaft, without axially rotating the now-immobile outer race.

3. The dual-drive mechanism system of claim 1, wherein the anti-axial-rotation means is a gyroscope system, which can be external to collar as illustrated, or, internal to collar, having a rotor element, freely rotatable about a fixed axle, its spin activated by a coaxial crank, that swings-out from inside handle, unfolds for axial rotation, then, folds back into handle as required, after rotor is caused to spin, with spin maintained, by a larger diameter toothed element coupled to the handle and meshing perpendicularly with a smaller diameter toothed element mounted and fixed to a first end of an axle, having a larger diameter rotational element mounted and fixed to the opposite end of said axle with said larger diameter rotational element driving a smaller diameter rotational element by a closed-ended roller chain, with said smaller sprocket mounted and fixed to a first end of a second axle, causing axle to rotate, which entrains the rollers of one-way roller clutch, which, pressed into the center bore of the rotor of the gyroscope, entrains and causes a high-speed rotation of gyroscope rotor, which resists environmental forces, that are perpendicular to its axial rotation and perpendicular to the driveshaft, thereby, maintaining the desired rotational immobility of collar independent of the gyroscope feature, the input member simultaneously activates the 2×-drive mechanism by causing the rotation of posterior driving element and its set of roller clutches which entrain drive shaft while causing rotation of reversing element which causes the rotation of anterior driving element and its set of roller clutches.

4. The dual-drive mechanism system of claim 1, wherein the anti-axial rotation means is comprised of a first ring-shaped element, having a flat, smooth, surface, rotatably mounted perpendicular to drive shaft and coupled to and rotating with said first driving element; a second ring-shaped element having a flat, smooth surface, rotatably mounted perpendicular to drive shaft and coupled to and rotating with said second driving element, which is forced to always rotate oppositely of first driving element; a third element having oppositely facing flat, smooth, parallel surfaces, perpendicular to drive shaft, disposed between and maintaining sliding contact with, the flat, smooth surfaces of the oppositely rotating first and second ring-shaped elements, whereby the opposite rotations of said first and second ring-shaped elements, bearing against opposite surfaces of third element, with sliding contact, causes a rotation-cancelling effect, thereby resulting with the third element being forced to remain immobile; third element is coupled to Collar of claim 1, thereby forcing Collar to also remain stationary, thereby eliminating the need of either of user's hands to hold Collar stationary and conveniently enabling user's opposite hand to hold a work piece, while user's one hand applies axial rotation to the input handle.

5. The dual-drive mechanism system of claim 1, wherein the anti-axial-rotation means is a removable weight element, that attaches to the exterior surface of collar with spring-loaded ball plungers, that are captured by detents provided through surface of collar, wherein a Removable weight element is acted upon by gravity, to prevent axial rotation of collar, thereby enabling the 2×-drive feature to be activated, by bidirectional rotation being applied to input handle with one hand, while one's opposite hand is made available for holding a workpiece; and a Removable weight element is detached as required, to obtain a conventional ratcheting and single-drive mode.

6. The dual-drive mechanism system of claim 1, wherein the anti-axial-rotation means is an inline handle disposed at the posterior end, rotatably mounted to a bracket, that serves as a bridge, that bypasses the posterior driving element and supports axle, that is mounted with a sprocket fixed at one end and the reversing element fixed to said axle's opposite end for driving the reversing element, thereby activating the 2×-drive feature single-handedly, while user's opposite hand is available for holding a workpiece; The reversing element is driven by means such as said sprockets and closed loop chain, or pulleys and a closed loop belt or gear train, driven by gear, which drives gear and sprocket, both of which are mounted onto axle.

7. The dual-drive mechanism system of claim 1, wherein the anti-axial-rotation means is a combination of at least any two of the means.

8. The dual-drive mechanism system of claim 1, wherein the anti-axial-rotation means is an output drive shaft, positioned non-concentric with the input shaft, thereby creating an offset, equal to a lever arm, to provide a required counter-force, that conveniently replaces the use of one of user's hands.

9. The dual-drive mechanism system of claim 1, wherein the anti-axial-rotation means is a concentric third shaft serving as the output and an off-take of the offset shaft, with the third shaft resting atop, but, not fastened to, the concentric input shaft, which also serves as a support and a stabilizing end-guide for the third shaft.

10. The dual-drive mechanism system of claim 1, wherein the two driving elements are a pair of gear-driven ratchet wheels and mating pawls, a posterior set and an anterior set, that alternatingly engage with and disengage from the drive shaft, with one ratchet wheel and pawl engaged to entrain the drive shaft, while the other ratchet wheel and pawl is disengaged from and overrides the driveshaft.

11. The dual-drive mechanism system of claim 1, wherein the two driving elements are two sets of gear-driven roller clutches, a posterior set and an anterior set, that alternatingly engage with and disengage from the drive shaft, with one set of roller clutches caused to engage to entrain the drive shaft while the other set of roller clutches is simultaneously caused to disengage from and override the driveshaft.

12. The dual-drive mechanism system of claim 1, wherein the invertible gear-train system is comprised of a set of different-sized gears, fixed on axles, arranged to produce an amount of rotations, that are greater at the driving end than the amount of rotations applied to the input end for speed-multiplication requirements and capable of being inverted, to produce an amount of rotations at the driving end, that are less than the amount of rotations applied to the input, for higher torque requirements, is internally coupled inline with the drive shaft, with a knob provided on the external surface of collar to easily invert the gear-train as required.

13. The dual-drive mechanism system of claim 1, wherein a secondary handle is pivotally coupled to the collar, for pivoting to parallel with driveshaft when not in use and for being pivoted to perpendicular to driveshaft for applying radial swing for leverage, stability of the system during use and preventing axial rotation of collar, when conventional ratcheting mode is required for applying finishing-torque to threaded fasteners.

14. The dual-drive mechanism system of claim 1, wherein the reversing element is a gear, that, simultaneously attaches with the two driving elements and causing the two driving elements to always rotate axially, in opposite directions.

15. The dual-drive mechanism system of claim 1, wherein the anti-axial-rotation means is an adjustable two-ended tether, with one end anchored to a user such as via a belt clip, a belt loop, shoe, anchored to the ground, or to a wall or ceiling, or doorknob, while the opposite end is tautly attached to the collar to prevent its axial rotation while driving fasteners.

* * * * *